US005711231A

United States Patent [19]

Couvrette et al.

[11] Patent Number: 5,711,231

[45] Date of Patent: Jan. 27, 1998

[54] SERVICE ACCESS SYSTEM FOR AUTOMATIC TELLER KIOSK

[76] Inventors: Edward F. Couvrette, 10821 Airport Dr., El Cajon, Calif. 92020; Alvin E. Attig, 10250 Prospect Ave. #1, Santee, Calif. 92071; Carl J. Jeffrey, 2141 Palomar Airport Rd. #360, Carlsbad, Calif. 92009

[21] Appl. No.: 813,876

[22] Filed: Mar. 7, 1997

[51] Int. Cl.[6] ..... E05G 1/00

[52] U.S. Cl. ..... 109/2; 109/24.1; 109/47; 109/48; 109/70; 194/350; 902/34; 902/35

[58] Field of Search ..... 109/2, 24.1, 45–48, 109/69–71; 52/65, 32, 36.1; 49/246; 902/32, 33, 34, 35; 194/350

[56] References Cited

U.S. PATENT DOCUMENTS

| | | | |
|---|---|---|---|
| 4,399,755 | 8/1983 | Wiedmann | 109/2 |
| 4,497,261 | 2/1985 | Ferris et al. | 109/24.1 X |
| 4,649,832 | 3/1987 | Hain et al. | 109/24.1 |
| 4,856,437 | 8/1989 | Trucksess | 109/24.1 |
| 4,884,514 | 12/1989 | Shockey et al. | 109/2 X |
| 5,379,704 | 1/1995 | Couvrette | 109/24.1 |

*Primary Examiner*—Lloyd A. Gall
*Attorney, Agent, or Firm*—John R. Duncan; Frank D. Gilliam

[57] ABSTRACT

A secure servicing system for an automatic teller machine (ATM) or similar machine. An ATM is mounted on a rotatable/translatable baseplate in a kiosk with the operating side flush with an opening in the kiosk. By rotating and translating the baseplate, the ATM operating side is moved to a secure space inside the kiosk, providing access through a kiosk door for service. A blank side at least partially fills the opening. The baseplate is mounted on rollers and rotated by a driven bar connected between the baseplate and kiosk floor. An idler bar similarly connected guides translation of the baseplate during rotation. A sliding door, actuated by the baseplate translation idler bar, fills any space between one of the sides and the edge of the kiosk opening, where the side is narrower than the opening. A locking mechanism is provided to releasably lock the baseplate in either position. The kiosk is thus secure during service, adding of cash, when out of service, etc.

14 Claims, 5 Drawing Sheets

SERVICE ACCESS SYSTEM FOR AUTOMATIC TELLER KIOSK

BACKGROUND OF THE INVENTION

This invention relates in general to automatic teller machines (ATM) located in kiosks and, more particularly, to apparatus for permitting access to the machines for repair, replenishment or the like from a secure location within the kiosk.

Self banking systems, in the form of an ATM housed in a kiosk, are coming into widespread use. While some are located at bank branches with outside access, primarily for use when the bank is closed, others are being provided in stand-alone locations in shopping centers, parking lots, etc. for both walk-up and drive-up use. In many cases, such as when positioned on islands between drive-up lanes or in existing hallways, the kiosk must be very narrow and compact to avoid obstructing adjacent areas or driving lanes when the kiosk is positioned on an island between lanes. In addition, when the ATM requires replenishment of cash or repairs, the ATM must be accessible without obstructing adjacent areas. The unit must be resistant to break-ins due to the substantial amounts of cash often enclosed. Further, security must be provided for persons servicing, or delivering cash to, the ATM.

Typically, prior ATM kiosks have provided a swinging door arrangement which, when pivoted away from the kiosk, permits entry for repair or replenishment. These doors obstruct the adjacent area and can sometimes be easily pried open. Others use a rotating quarter-cylinder housing for the ATM, such as that described by Hain et al in U.S. Pat. No. 4,649,832. This is wasteful of space within the kiosk and obstructs the adjacent area when opened. Still other kiosks simply provide a back door through which the kiosk can be entered for access to the ATM. These, of course require a great deal of interior volume, which is not available in many locations and leaves the operating panel exposed. In addition, these arrangements require a person servicing or replenishing the ATM to stand outside the kiosk, subject to weather conditions and to robbery.

My prior U.S. Pat. No. 5,379,704 describes a ATM kiosk service system in which the ATM unit is rotatable between a use position with the operating panel exposed for use and a service position with the operating panel oriented toward a kiosk interior service area and a blank panel replacing the operating panel. While very effective, improvements in the ATM unit rotation system for simplicity, lighter weight and efficiency would be desirable.

Thus, there is a continuing need for improved ATM kiosks and apparatus for permitting full access to the ATM for servicing while assuring maximum security during use, occupying a minimum volume, avoiding obstructing adjacent areas during servicing and permitting rapid, convenient movement of the ATM unit between operating and service positions.

SUMMARY OF THE INVENTION

The above noted problems, and others, are overcome in accordance with this invention by an apparatus for rotating an ATM installed in a kiosk approximately 90° from a first or operating position with the ATM control panel extending through an opening in the kiosk wall to a second or service position within the kiosk.

The ATM, including the operating controls, means for receiving deposits, cash box and means for dispensing cash, associated computer, etc are all arranged in a generally upright rectangular box or housing. In the operating position the operating side, including keyboard, information screen and deposit receiving and cash dispensing openings, etc. are exposed and preferably substantially flush with a kiosk opening for ease of use. In the service position, the box is rotated to expose the ATM components, cash box, etc. for servicing. For optimum security the ATM includes a high strength security panel which covers the kiosk opening when the ATM is rotated to the servicing position.

An object, therefore, of this invention is to provide a simple, light weight and reliable apparatus for providing movement of an ATM between operating and servicing positions which minimizes the kiosk volume required for the ATM. Another object is to provide an ATM kiosk arrangement that does not require obstruction of adjacent areas during servicing. A further object is to provide an ATM kiosk and servicing apparatus having high security and resistance to break-ins. Still another object is to provide a mechanism for moving an ATM until between an operating position and a service position that can be manually operated by one person.

BRIEF DESCRIPTION OF THE DRAWING

Details of the invention, and of certain preferred embodiments thereof, will be further understood upon reference to the drawing, wherein.

Figure 2:
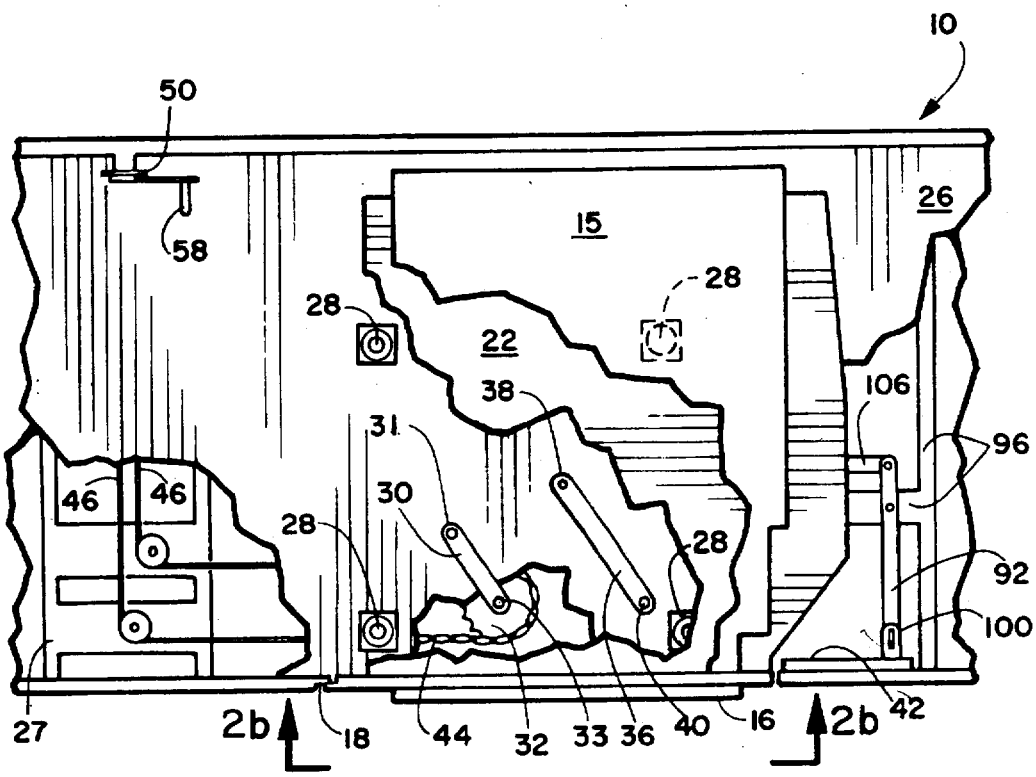
FIG. 2 is a schematic plan view of the ATM rotation mechanism in the operating position.
Figure 3:
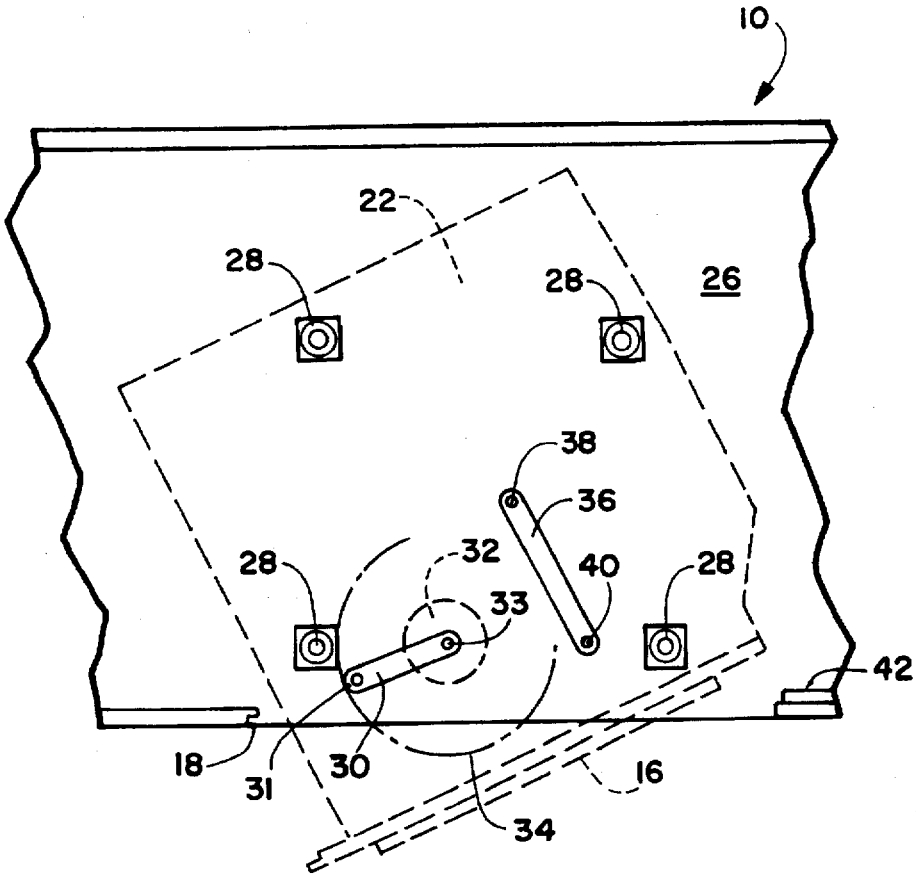
Figure 4:
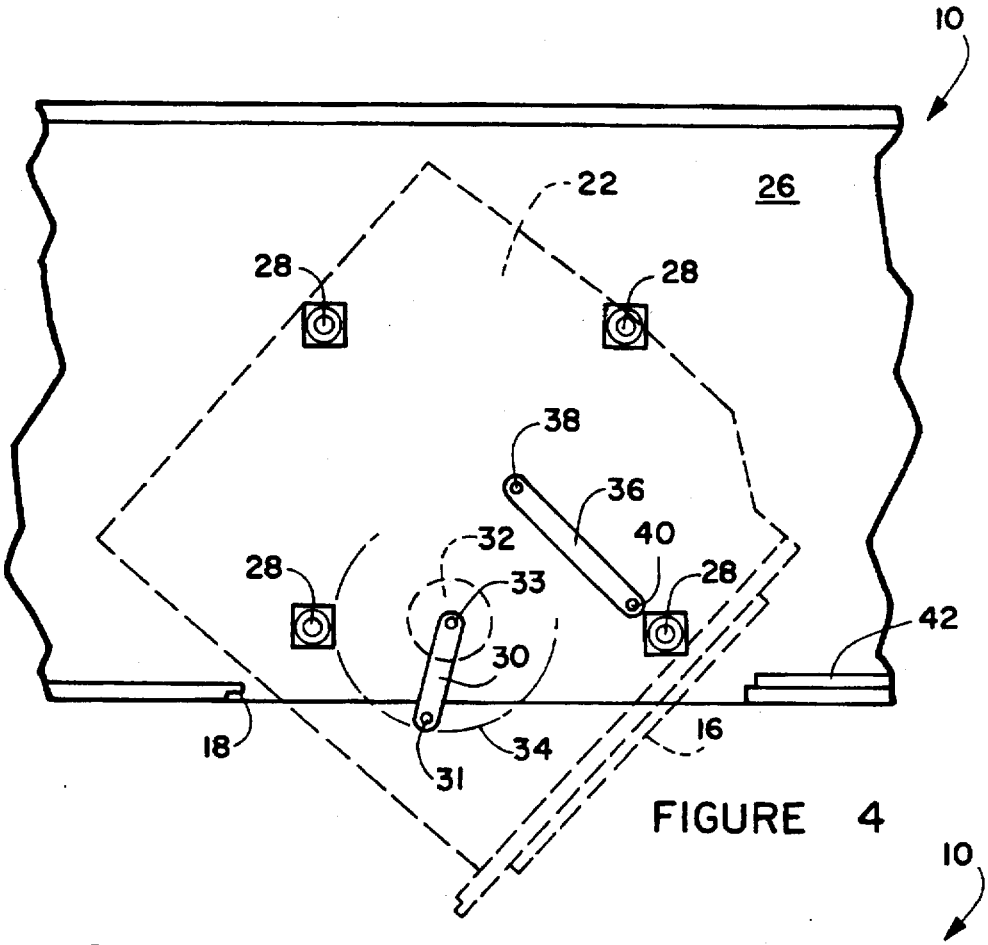
Figure 5:
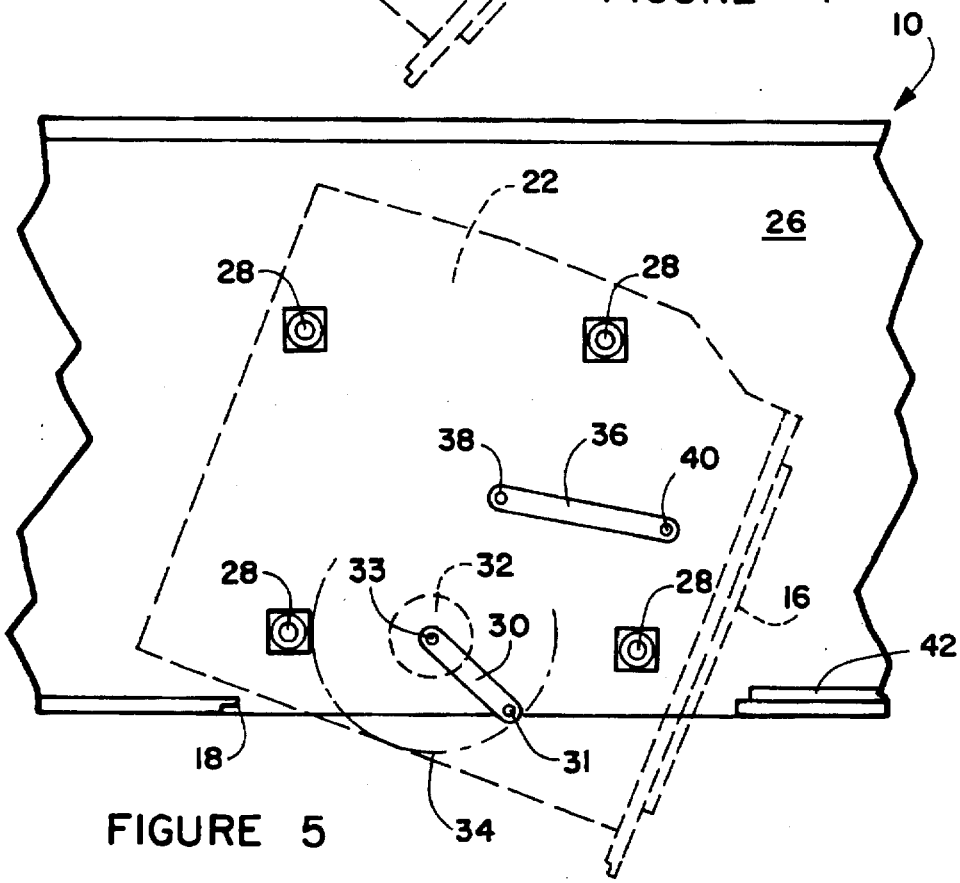
Figure 6:
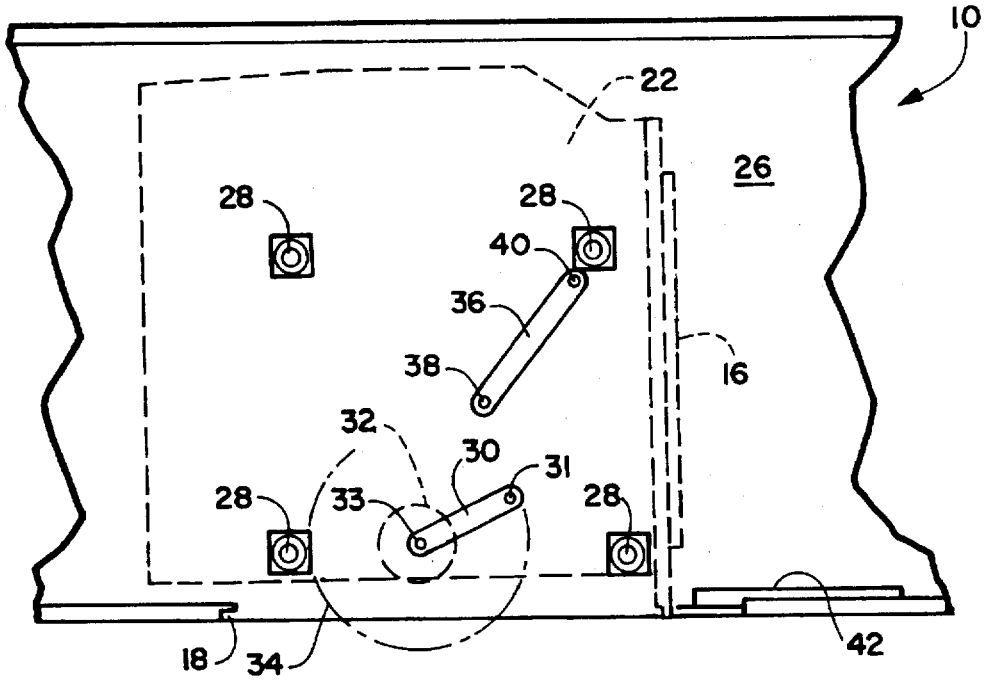
Figure 7:
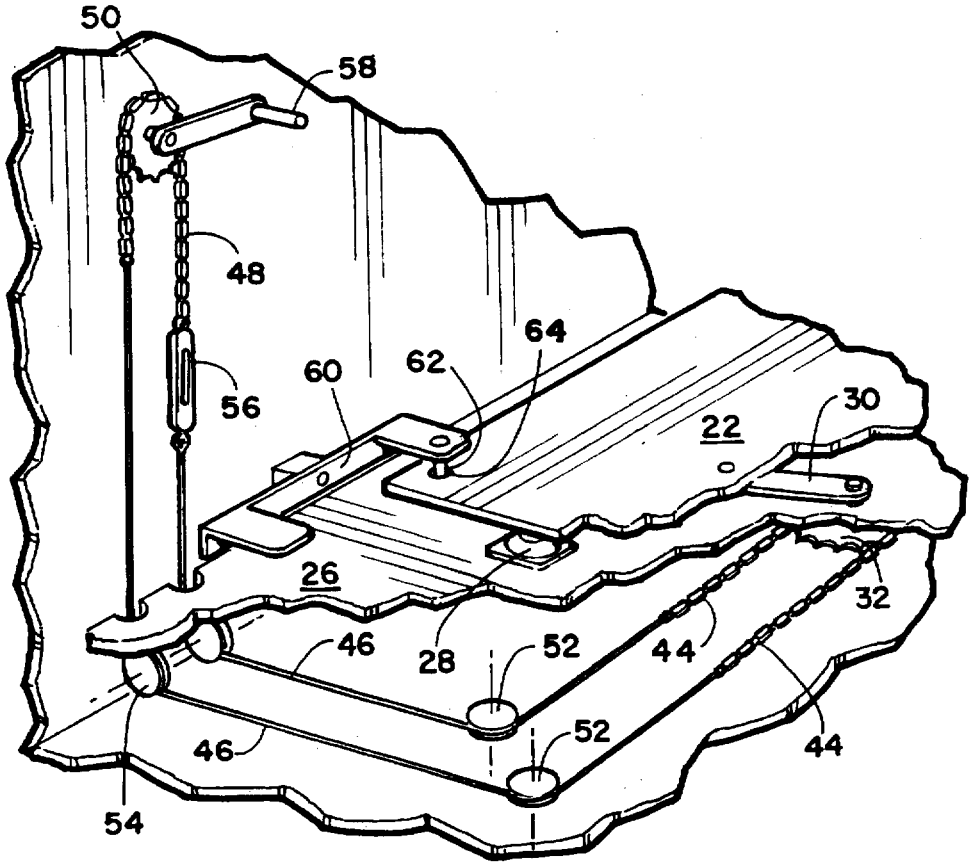

FIG. **2*b* is a detail section view taken on line 2*b*—2*b* in FIG. 2**;

FIG. 3 is a schematic plan view of the ATM rotation mechanism at a first stage of rotation;

FIG. 4 is a schematic plan view of the ATM rotation mechanism at a second stage of rotation;

FIG. 5 is a schematic plan view of the ATM rotation mechanism with rotation nearly complete;

FIG. 6 is a schematic plan view of the ATM rotation mechanism with rotation to the service position complete;

FIG. 7 is a schematic perspective view of the rotation cranking system; and

Figure 8:
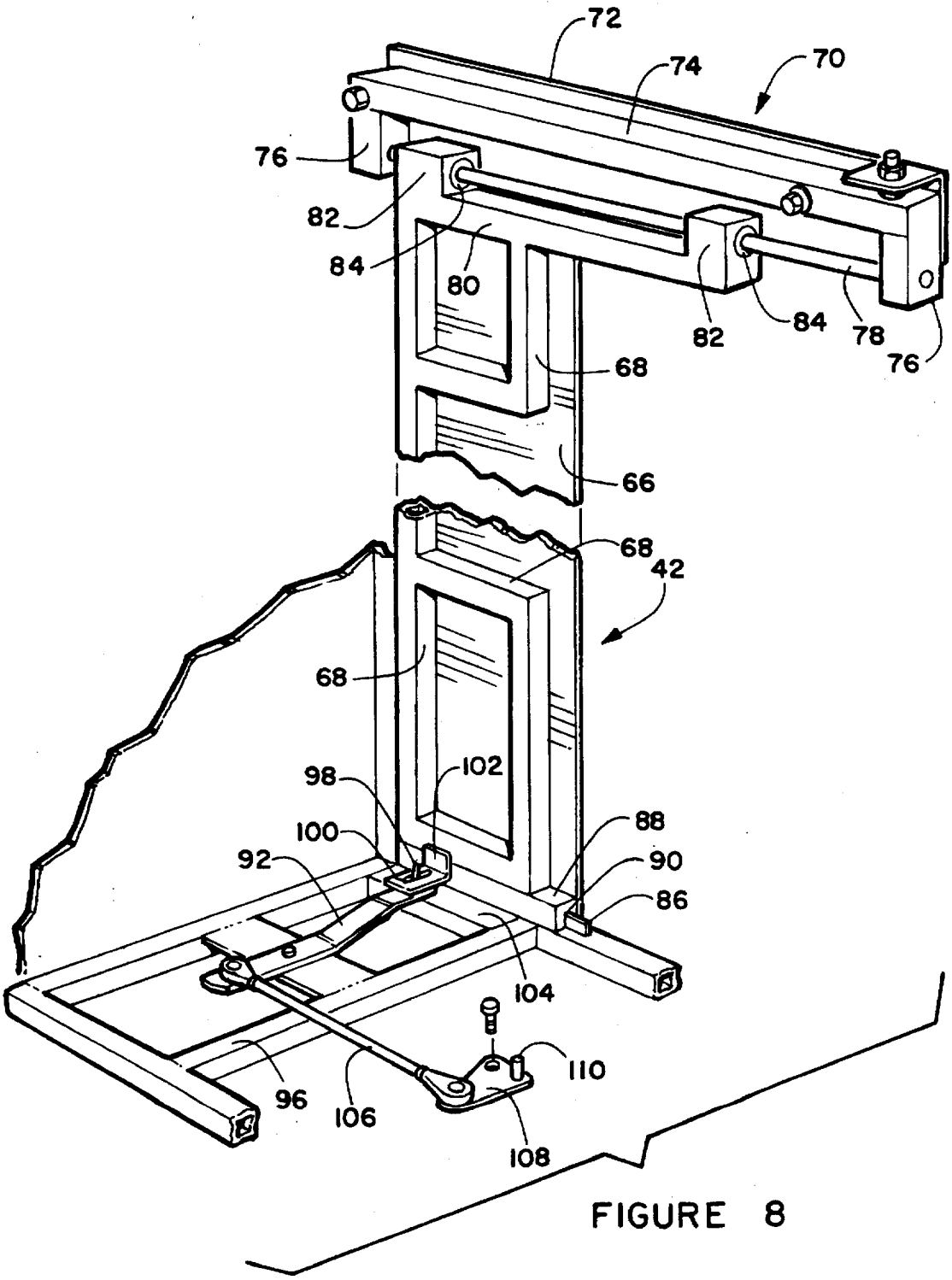

FIG. 8 is a schematic exploded perspective view of the edge door operating system.

DETAILED DESCRIPTION OF PREFERRED EMBODIMENTS

Figure 1:
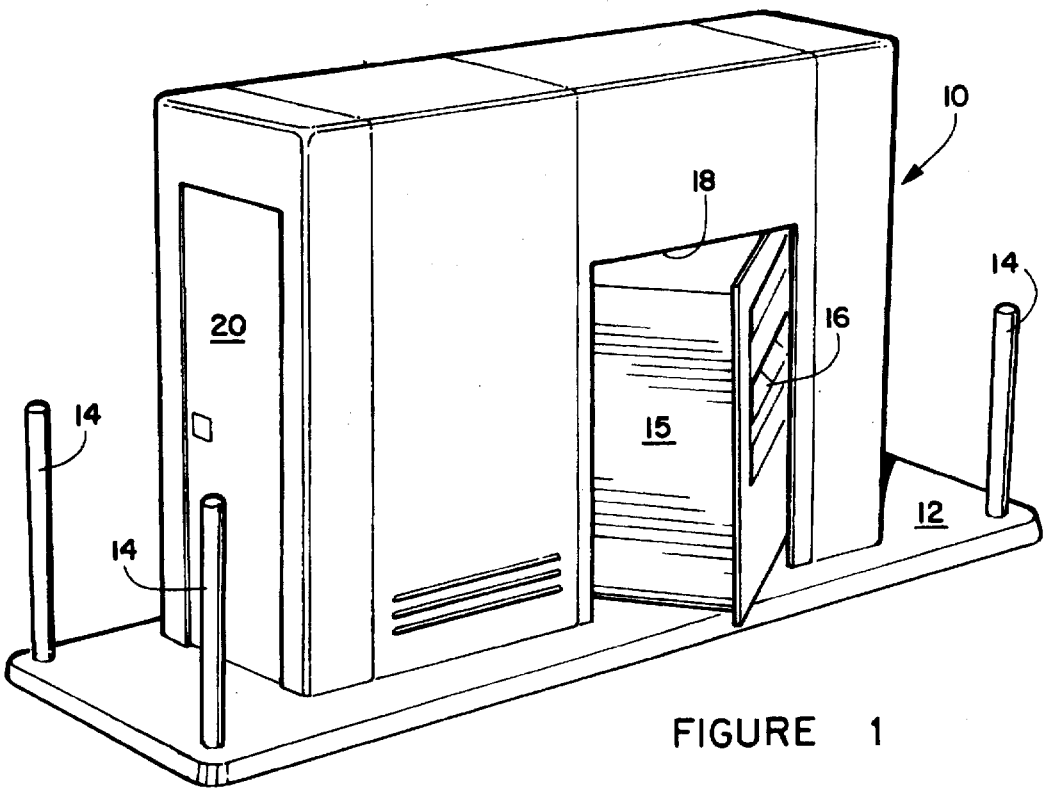
FIG. 1 is an exterior perspective view of an ATM kiosk according to this invention.

Referring to FIG. 1, there is seen a kiosk 10 mounted on a raised base 12. Where base is adjacent to a roadway, protective posts 14 are preferred to protect against vehicle impacts. An automatic teller machine (ATM) 15 or the like, when in use, has the operating panel 16 exposed at opening 18 in the front of the kiosk. Panel 16 is shown about half way between the operating position where panel 16 fills opening 18 and the service position where a blank side of ATM 15 is exposed and fills opening 18.

A service access door 20 permits entrance into the kiosk end opposite ATM 15 for replenishing cash, collecting deposits, servicing the equipment, etc. Door 20 could be at the end as shown or on either side adjacent that end, as convenient. In the service position, the side of ATM 15 opposite ATM operating panel 16 is exposed to the service area.

Figure 2B:
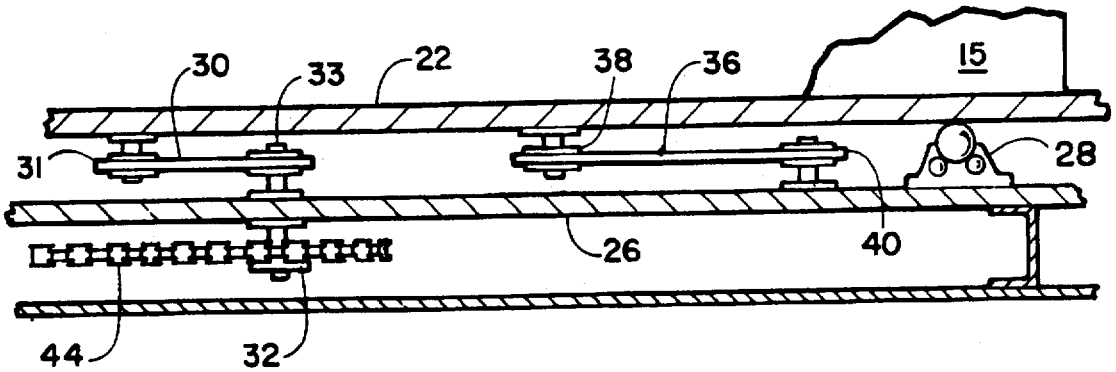

FIGS. 2–6 are plan views of the inside bottom of kiosk 10, with the ATM removed for clarity. ATM 15 is supported on a heavy steel plate 22 such as by bolts, latches or the like. Typically, plate 22 may be ½ inch thick AR500 steel. FIGS. 2 and 2b show plan and detail section views of plate 22 in the ATM operating position and FIG. 6 shows the service position, with the other figures illustrating progressive rotation of plate 22 from the operating position to the service position. Plate 22 is spaced above floor 26 of kiosk 10. Floor 26 will be formed from steel plate similar to plate 22 and supports the mechanism for moving plate 22 and the ATM mounted thereon.

For clarity in showing the operating mechanism between base plate 22 and floor 26, plate 22 is shown in phantom, just as if plate 22 were transparent.

Plate 22 is supported on a plurality of transfer bearings, which are preferably large self-contained and lubricated stainless steel ball bearings. Bearings 28 are mounted on the floor 26 of kiosk 10, with each ball portion extending upwardly into contact with the underside of plate 22. Various conventional reinforcing framing members 27 may be provided on floor 26, as desired. While any suitable number of bearings 28 may be used, four such bearings, positioned so that plate 22 will be supported during rotation are effective.

A driven arm 30 is rotatably mounted at a first end 31 end on plate 22. The other end 33 of arm 30 is pivotally connected to floor 26. A gear 32 is mounted for rotation with arm 30 for power rotation, as detailed below in conjunction with the description of FIG. 7. A chain, typically a bicycle-type chain and cable system extends from gear 32 to the drive and control system shown in FIG. 7. All arc 34 shows the extent of rotation of arm 30 in each direction as the ATM is moved back and forth between the two positions.

An idler arm 36 is pivotally mounted at a first end 38 to plate 22 and at a second end 40 to floor 26 to guide movement of plate 22 during powered rotation of driven arm 30 so that plate 22 both rotates and translates toward and away from the kiosk opening 18.

FIG. 2 shows the initial position with the ATM available for use. In order to begin the sequence of movement to the service position, gear 32 and arm 30 are rotated counterclockwise. As rotation of gear 32 begins, plate 22 begins to rotate on bearings 28 as seen in FIG. 3. The left forward edge of plate 22 moves out of opening 18 and the right end moves slightly back into the kiosk. During the first approximately 45° of rotation, idler arm 36 moves very little and can be considered to be loitering near its start point. Idler arm 36 moves backward a very small amount, typically about ⅝ inch at end 40.

As rotation of gear 32 continues, as seen in FIG. 4, end 40 of idler arm 36 begins movement toward the rear of kiosk 10, translating plate 22. A corner of plate 22 projects the maximum distance out of opening 18. The lower left edge of plate 22 continues to just clear the edge of opening 18.

With further rotation of gear 32, as seen in FIG. 5, idler arm 36 begins to guide plate 22 back, into the kiosk. Driven arm 30, which had projected slightly out of opening 18 moves back inside kiosk 10. A sliding narrow door panel 42, described in detail in conjunction with the description of FIG. 8, below, has begun to extend from the right side of opening 18 to fill the gap between the edge of opening 18 and the side of plate 22 in the service position.

As seen in FIG. 6, rotation of gear 30 is complete and plate 22 is fully moved to the service position. A blank, sturdy, side of the ATM mounted on plate 22 fills opening 18 from the left side to near the right side. Sliding door 42 fills the gap that would otherwise be present at the right side of opening 18. A comparison of FIGS. 3 and 6 will show that plate 22 and the ATM have greater width in the operating position of FIG. 3 than in the service position of FIG. 6. Once in the service position of FIG. 6, a technician can enter the kiosk to replenish cash or service the ATM in a secure environment.

FIG. 7 is a perspective view of the system for driving plate 22 and the ATM thereon between the operating and service positions. A length of chain 44, such as conventional bicycle-type chain, engages gear 32. Cords 46 run from ends of chain 44 to ends of a second, similar, chain 48 that engages a small gear 50. Cords 46 pass over idler pulley sets 52 and 54 to change direction from horizontal along the floor 26 of kiosk 10 to upwardly along a back wall of the kiosk. While chains and idler gears could be used in place of the combination of cord and chains, the cord insert allows use of the more convenient idler pulleys. A spring 56 may be included in the cord and chain length to assure that slack is taken up.

A crank handle 58 engaging gear 50 is preferably used to rotate the gear and drive the rotation of plate 22 and the ATM between operating and service positions. To save space within the service area of the kiosk, handle 58 is preferably removable. If desired, electric motor drive could be used. However, the manual crank system is preferred since it will work even in the event of a power outage. Besides use during ATM servicing, the ability to rotate the ATM to a safe position with the operating panel secured may be useful in the even of an earthquake, flood, riot or other condition where power may not be available and improved security of the ATM is necessary.

While the gear system will resist attempts to manually rotate the ATM by grasping or prying the exposed panel when in the service, secured, position, a manual lock is preferably included. A lever 60 is pivotally secured to back wall 55 and has a downwardly extending pin 62. A corresponding hole 64 is formed in plate 22. With the lever disengaged, as shown, plate 22 and the ATM may be moved between the operating and service positions. Pin 62 may be inserted into hole 64 in plate 22 to securely lock plate 22 against movement. Pressing down on the end of lever 60 will disengage the lock so that cranking to rotate the ATM can begin.

FIG. 8 shows the tall, narrow sliding door 42 in detail. This door fills the space along the side of opening when plate 22 is rotated from the operating position to the service position, in which the exposed surface is somewhat narrower.

Door 42 includes an outer panel 66 supported by frame members 68. The door is suspended from the top by a suspension assembly 70 mounted on a bracket 72 which is fastened to the inside surface of the kiosk above the door area. A bar 74 fastened to bracket 72 includes two offset end blocks 76 having aligned holes for receiving a rod 78. A bar 80 with end blocks 82, generally similar to bar 74 and blocks 76 but shorter slidingly fits over rod 78 and is fastened to a door frame 68. For ease of movement, linear bearings 84 are inserted into the rod receiving holes in blocks 82. Thus, bar 80 carrying door 42 can freely slide along rod 78 between positions away from opening 18 and overlapping opening 18.

At the bottom of door 42 an assembly is provided to move the door between positions. A thin upstanding ridge 86 is secured to one of floor frames 96 on floor 26. A lower member 88 on a door frame 68 includes a downward groove which slidably fits over ridge 86. A pivot arm 92 is pivotally mounted on a pin along a frame 96. An upstanding pin 98 at a first end of pivot arm 92 engages a hole 100 in a bracket 102 fastened to a door frame 68. A bar 104 is mounted on floor frames 96 to slidingly support the underside of pivot arm 92, opposite pin 98.

A connecting rod 106 is pivotally connected between the second end of pivot arm 92 and a first arm of pivot plate 108, which is rotatably mounted under plate 22. An actuator pin 110 on a second arm of pivot plate 108 engages a hole in idler arm 36 (FIG. 2).

Thus, as plate 22 is rotated to move the ATM between operating and service positions, door 42 is simultaneously moved to fill the gap at the side of opening 18 that would otherwise exist when the ATM was in the service position.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

We claim:

1. A service access system for a consumer operated machine kiosk which comprises:

a kiosk for housing a consumer operated machine with only one of a first operating side of the machine and a second non-operating side exposed at the kiosk exterior through an opening in said kiosk;

a floor in said kiosk;

a machine baseplate;

a plurality of roller means between said machine baseplate and said floor to allow said machine baseplate to freely move relative to said floor;

an idler bar rotatably connected to a first pivot point on said floor and a second pivot point on said machine baseplate;

a driven bar rotatably connected between a third pivot point on said floor and a fourth pivot point on said baseplate;

drive means for rotating said driven bar about said third pivot point;

said pivot points and bars configured so that said baseplate simultaneously rotates and translates to move said machine operating side between an operating position substantially flush with said kiosk opening and at least partially filling said opening and a service position with said machine operating side within said kiosk and said second side substantially flush with said kiosk opening and at least partially filling said opening.

2. The service access system according to claim 1 further including;

a slidable door adjacent to one side of said kiosk opening;

door actuation means for moving said slidable door between a first door position out of said kiosk opening and a second door position filling space between a side of said opening and said machine in one of said operating and service positions.

3. The service access system according to claim 2 wherein said door actuation means comprises:

a rod mounted within said kiosk above said door;

hanger means at a door top end slidably mounted on said rod;

guide means at a door bottom end for guiding door sliding movement;

connection means for sliding said door in accordance with baseplate movement.

4. The service access system according to claim 3 wherein said connection means comprises:

a pivot arm mounted for pivoting about a point intermediate ends of said pivot arm;

a first pivot arm end operatively connected to said door; and a second pivot arm end connected to said idler bar;

whereby said door is moved in accordance with baseplate movement.

5. The service access system according to claim 1 wherein said drive means comprises a driven gear secured to said driven bar and coaxial with said third pivot point, chain and cable means connecting said driven gear to a remote drive gear and means for rotating said drive gear.

6. The service access system according to claim 1 wherein said consumer operated machine is an automatic teller machine, said kiosk includes a work space adjacent to said automatic teller machine and an entrance door into said work space, and said operating side is exposed to said work space when said second side is exposed at said exterior.

7. The service access system according to claim 1 wherein said roller means comprises ball-type rollers mounted on said floor with said baseplate resting on said roller means so that said baseplate may be freely moved in any direction.

8. The service access system according to claim 1 further including a pin mounted on an interior wall of said kiosk adjacent to said baseplate, at least one hole in said baseplate configured to receive said pin when said baseplate is in at least one of said operating and service positions and operating means for moving said pin into and out of said at least one hole.

9. A service access system for a consumer operated machine kiosk which comprises:

a kiosk for housing a consumer operated machine with only one of a first operating side of the machine and a second service side exposed at the kiosk exterior through an opening in said kiosk;

a floor in said kiosk;

a machine baseplate;

a plurality of ball-type roller means between said machine baseplate and said floor to allow said machine baseplate to freely move relative to said floor;

an idler bar rotatably connected to a first pivot point on said floor and a second pivot point on said machine baseplate;

a driven bar rotatably connected between a third pivot point on said floor and a fourth pivot point on said baseplate;

drive means for rotating said driven bar about said third pivot point;

said pivot points and bars configured so that said baseplate simultaneously rotates and translates to move said machine operating side between an operating position substantially flush with said kiosk opening and a service position with said second machine side substantially flush with said opening;

a vertical gap along one side of said opening with said machine in one of said positions in said opening;

a slidable door adjacent to said one side of said kiosk opening; and door actuation means for moving said slidable door between a first door position out of said kiosk opening and a second door position filling space between a side of said opening and said machine in one of said positions.

10. The service access system according to claim 9 wherein said door actuation means comprises:

a rod mounted within said kiosk above said door;

hanger means at a door top end slidably mounted on said rod;

guide means at a door bottom end for guiding door sliding movement;

connection means for sliding said door in accordance with baseplate movement.

11. The service access system according to claim 10 wherein said connection means comprises:

a pivot arm mounted for pivoting about a point intermediate ends of said pivot arm;

a first pivot arm end operatively connected to said door; and a second pivot arm end connected to said idler bar;

whereby said door is moved in accordance with baseplate movement.

12. The service access system according to claim 9 wherein said drive means comprises a driven gear secured to said driven bar and coaxial with said third pivot point, chain and cable means connecting said driven gear to a remote drive gear and means for rotating said drive gear.

13. The service access system according to claim 9 wherein said consumer operated machine is an automatic teller machine, said kiosk includes a work space adjacent to said automatic teller machine and an entrance door into said work space, and said operating side is exposed to said work space when said second side is exposed at said exterior.

14. The service access system according to claim 9 further including a pin mounted on an interior wall of said kiosk adjacent to said baseplate, at least one hole in said baseplate configured to receive said pin when said baseplate is in at least one of said operating and service positions and operating means for moving said pin into and out of said at least one hole.

* * * * *